United States Patent [19]

Harbaugh

[11] 4,452,162

[45] Jun. 5, 1984

[54] CORNER STRUCTURE FOR CRYOGENIC INSULATION SYSTEM

[75] Inventor: Donal E. Harbaugh, Santa Ana, Calif.

[73] Assignee: McDonnell Douglas Corporation, Long Beach, Calif.

[21] Appl. No.: 484,358

[22] Filed: Apr. 19, 1983

Related U.S. Application Data

[63] Continuation of Ser. No. 909,929, May 26, 1978, abandoned.

[51] Int. Cl.[3] ..... B63B 25/08

[52] U.S. Cl. ..... 114/74 A; 220/901; 220/452

[58] Field of Search ..... 114/74 R, 74 A; 220/408, 428, 444, 445, 450, 453, 901

[56] References Cited

U.S. PATENT DOCUMENTS

| | | | |
|---|---|---|---|
| 3,080,086 | 3/1963 | James | 220/901 |
| 3,337,079 | 8/1967 | Clarke et al. | 114/74 A |
| 3,399,800 | 9/1968 | Gilles | 114/74 A |
| 4,116,150 | 9/1978 | McCown | 114/74 A |

*Primary Examiner*—Trygve M. Blix

*Assistant Examiner*—Jesûs D. Sotelo

*Attorney, Agent, or Firm*—Max Geldin

[57] ABSTRACT

Cryogenic insulation system for containers for storage of cryogenic liquefied gases such as LNG (liquid natural gas), comprised of a low temperature resistant metal, preferably high nickel steel, membrane or liner supported by a layer of reinforced foam insulation. There is provided at corners, for example at 90° corners, and disposed within the foam insulation layer, a corner structure comprised of a low temperature resistant metal, preferably high nickel steel, e.g. Invar, angle member, to which such membrane is attached, a support or back-up member for such angle member, a plurality of low thermal conductivity high strength metal, e.g. stainless steel, strips or fingers attached as by welding, to the angle member, such fingers being in the plane of the membrane, the fingers being attached at their outer ends to connectors which are attached to the container wall or ship hull. The fingers transmit loads from the metal membrane through the container wall or ship hull. An insulation support panel is provided for supporting the foam insulation at the corner.

4 Claims, 9 Drawing Figures

CORNER STRUCTURE FOR CRYOGENIC INSULATION SYSTEM

This application is a continuation, of application Ser. No. 909,929, filed May 26, 1878 now abandoned.

BACKGROUND OF THE INVENTION

This invention relates to containers, tanks, or ships, for the storage or transportation of cryogenic liquids such as liquid natural gas (LNG), and is particularly concerned with containers, tanks or ships of the above type containing non-metallic, e.g. plastic, foam insulation and one or more liners, and preferably a low temperature resisting, e.g. low thermal expansion, liner such as high nickel steel, and a simple yet strong support structure for the liner or membrane at the corners, such corner structure being readily fitted into the foam insulation at the corner and permitting transmission of loads at various angles from the liner to the tank wall or ship hull, with minimum heat transmission to the cold contents.

A container or tanker for the storage and/or transportation of a cryogenic liquid must be designed to withstand extremely cold temperatures. Generally vessels of this type are composed of an outer wall of a rigid structure, a heat insulating layer provided at the inside surface of such wall and an inner membrane on the inside surface of such heat insulating layer. Often several heat insulating layers of non-metallic, e.g. plastic, foam insulation, are employed and one or more membranes, particularly an inner liner or membrane such as a nickel steel liner in contact with the cryogenic liquid and one or more additional secondary liners positioned between foam insulating layers. The primary liner, generally made of a thin low temperature resistant (low thermal expansion) material such as nickel steel, is maintained in close contact with the surface of the adjacent heat insulating layer and transmits the internal pressure applied by the low temperature liquefied gases through the heat insulating layers to the outer container or the hull of a tanker. Illustrative of such a system is U.S. Pat. No. 3,814,275, to Lemons.

Of particular importance, the container or its insulation system must be capable of withstanding the thermal strains induced by the cold liquid and the transients during the cooling and warming cycles caused by the loading and unloading of the liquid, and the mechanically induced strains from the ship hull or container displacement during operation.

Critical portions of such cryogenic insulation systems for supporting the primary liner are at the corners where loads to which the liner is subjected, are transmitted to the container wall or ship hull. In membrane systems of the above type, designed to contain cryogenic liquids, the corners must be secured against movement caused by membrane contraction and deflection of the supporting structure. Such corner structures must resist loads at various angles and in a number of different directions with minimum heat transmission to the cold cargo.

Various corner designs for insulated cryogenic containers or ships have been developed in the prior art. Exemplary of such structures are those disclosed in Gilles, U.S. Pat. No. 3,399,800; Helf et al., No. 3,931,424; and Clarke et al. No. 3,337,079.

Also, in applications Ser. Nos. 665,285, filed Mar. 9, 1976 of McCown, now U.S. Pat. No. 4,116,150 and 759,910, filed Jan. 17, 1977 of McCown, now U.S. Pat. No. 4,170,952 and assigned to the same assignee as the present application, there are disclosed cryogenic insulation systems containing corner structures including tubular couplers and associated structure for connecting the liner to the container wall or ship hull at the corners.

However, one of the main difficulties of the relatively complex corner structures of the prior art is the difficulty involved in fitting the cryogenic insulation around the various components forming these corner structures, involving the use of intricate specially cut pieces of foam for this purpose, which substantially increases the cost of such cryogenic insulation systems.

SUMMARY OF THE INVENTION

It is accordingly an object of the present invention to provide a load carrying corner support for the metal liner of the cryogenic insulation system of tanks or ships, such corner support being incorporated into the foam insulation at the corners. Another object is to provide a cryogenic insulation corner support of the above type for transmission of loads at various angles and in various directions, in tension and in compression, from the primary liner to the tank wall or ship hull. A still further object is the provision of a simple yet strong corner support system of the above type and formed of a minumum of components, which permits the foam insulation to be readily fitted into and around the corner structure without the necessity of cutting the foam into complex small shapes for this purpose.

The above objects and advantages are achieved according to the present invention by the provision of a corner structure for a cryogenic insulation system formed of a layer or layers of plastic insulation, particularly layers of reinforced plastic foam insulation, in combination with a primary inner membrane or liner, particularly a low temperature resistant nickel steel membrane, such corner structure containing as essential components a plurality of metal fingers which are connected to the primary liner at the corner, and to the ship hull for transmitting loads from the membrane to the ship hull.

More specifically, the corner structure comprises a low temperature resistant metal, preferably high nickel steel, angle member to which the metal primary inner membrane is connected, e.g. as by welding. A support or back-up member for such angle member is positioned within the foam and bonded thereto, the support member being connected to the angle member. A plurality of strips or fingers, preferably of a low thermal conductivity and high strength material such as stainless steel, are connected at their inner ends to the metal angle member, as by welding, such strips being substantially in the plane of the inner liner or membrane. The outer ends of the strips or fingers are connected to the wall of the container or to the ship hull, by suitable means, such as fittings, e.g. in the form of "T" members.

The plurality of metal strips comprises a first series of spaced substantially parallel strips, such strips being substantially in the plane of the membrane in one direction thereof, at the corner, and a second series of spaced substantially parallel strips, such second series of strips being substantially in the plane of the membrane in the other direction thereof at the corner. The second series of strips are substantially in staggered relation with respect to the first series of strips.

The corner structure can be incorporated at corners of the tank of varying angles. Thus, the corner structure can be incorporated into a 90° corner, in which case the angle member is a 90° angle, and the first series of strips are disposed at a 90° angle to the second series of strips. If the corner structure of the invention is incorporated in a corner having an acute angle, the angle member is accordingly in the form of an acute angle, and the first series of strips are disposed similarly at an acute angle to the second series of strips. If the corner structure of the invention is incorporated at an obtuse angle of the container, the angle member is in the form of a corresponding obtuse angle, and the first series of strips are disposed at an obtuse angle to the second series of strips. In certain instances, as described more fully hereinafter, only one series of strips may be required at a corner.

In a preferred embodiment, a corner support panel is provided around the corner structure for supporting the foam insulation at such corner. Alternatively, the foam insulation can be bonded directly to the inner wall of the container or ship hull.

The corner structure for supporting the membrane or liner can be employed in conjunction with a metal membrane having a low coefficient of thermal expansion to contain cryogenic liquids in any type of container or storage tank for marine or land use.

The use of metal strips or fingers, formed of a material of low thermal conductivity and high strength such as stainless steel, in conjunction with a membrane formed of a material of low coefficient of expansion such as nickel steel results in efficient transmission of membrane loads in varying directions and angles from the inner metal membrane to the outer wall of the container or ship hull, and affords a minimum heat loss and minimum disruption of the foam insulation, thereby permitting facile incorporation of the foam insulation into and around such corner structure. The strip or finger width and/or thickness can be sized so as to accommodate or match the expected load intensity. Further, the strips extending in one direction can be wider and/or thicker than the strips in the other direction of the corner structure. In addition, where a secondary or inner liner such as a fiberglass liner, is employed in conjunction with the primary metal liner, the use of strips or fingers in the corner structure of the invention for connecting the primary liner to the container wall or ship hull, permits the passage of the fiberglass liner through the foam at the corner structure, thus assuring structural continuity of such fiberglass liner.

BRIEF DESCRIPTION OF THE DRAWINGS

The invention will be more fully understood by the description below of certain preferred embodiments, taken in connection with the accompanying wherein.

DESCRIPTION OF THE PREFERRED EMBODIMENT

Figure 1:
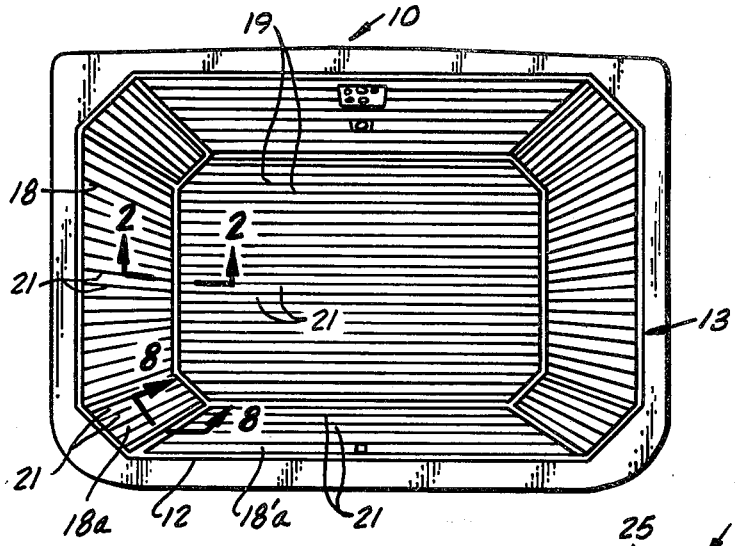
FIG. 1 is a perspective view showing a methane (LNG) container or tanker containing an insulation system and corner structure according to the invention.

Referring to FIG. 1 of the drawing, numeral 10 indicates a cryogenic liquid or LNG tanker having an inner hull 12 and an insulation system 13 positioned around the inner hull. Such insulation system is comprised of an outer fiber reinforced foam insulation layer 14 disposed against the inner hull 12, and an inner fiber reinforced foam insulatin layer 16. Such fiber reinforced foam insulation layers are preferably three-dimensional glass fiber reinforced polyurethane foam layers. Such fiber reinforced insulation material comprises blocks or planks of closed cell polyurethane foam having layers of glass fibers, each layer of fibers extending in both a horizontal and transverse direction, the X an Y reinforcement fibers, and layers of fibers extending in a vertical direction, the Z reinforcement fibers.

Figure 1A:
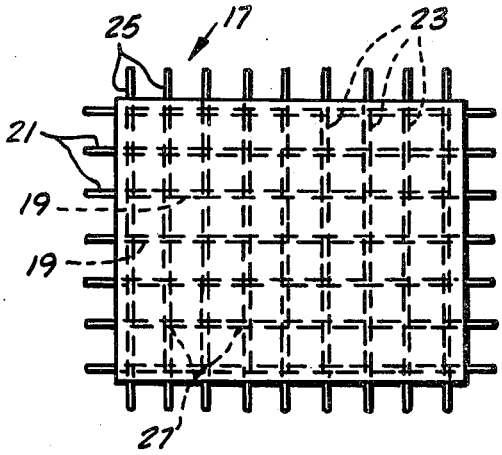
FIG. 1A illustrates a preferred type of fiber reinforced insulation material termed herein "3D" foam insulation employed in the system of FIG. 1.

FIG. 1A illustrates this type of material comprising blocks 17 of closed cell polyurethane foam having layers of glass fibers 19 embedded in the foam and having exposed fiber ends 21 to facilitate bonding of the reinforced polyurethane blocks 17 to a structural member such as a tank wall. The polyurethane block 17 has other glass fibers 23 extending vertically, with exposed fiber ends 25 to facilitate bonding of the individual blocks to each other, and layers of other fibers 27 extending horizontally and normal to the fibers 19. This type of reinforcement is known as X-Y-Z reinforcement, the X fibers being longitudinal fibers, the Y fibers transverse fibers and the Z fibers vertical fibers, e.g. as shown in U.S. Pat. No. 3,322,868, and the resulting reinforced foam is also known as "3D foam." Preferably, planks of such 3D polyurethane foam are bonded together, as at 13 in FIG. 2 by a suitable adhesive, preferably a polyurethane adhesive, to form the outer and inner insulation layers 14 and 16, respectively.

Figure 2:
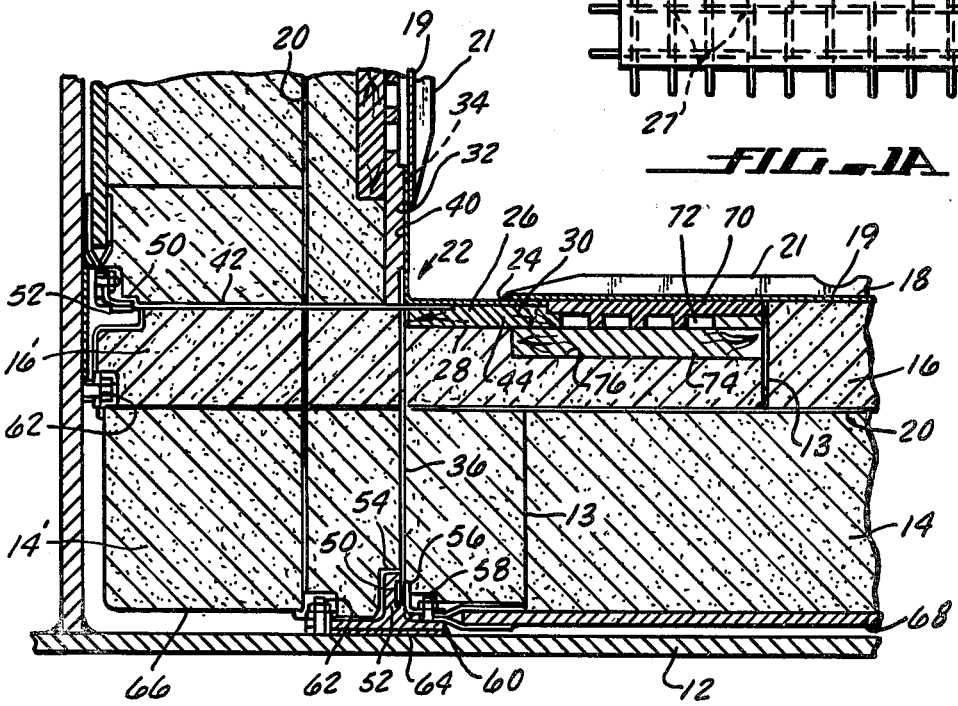
FIG. 2 is a 90° transverse corner section of the tank or tanker, taken on line 2—2 of FIG. 1, showing the corner structure of the invention.
Figure 3:
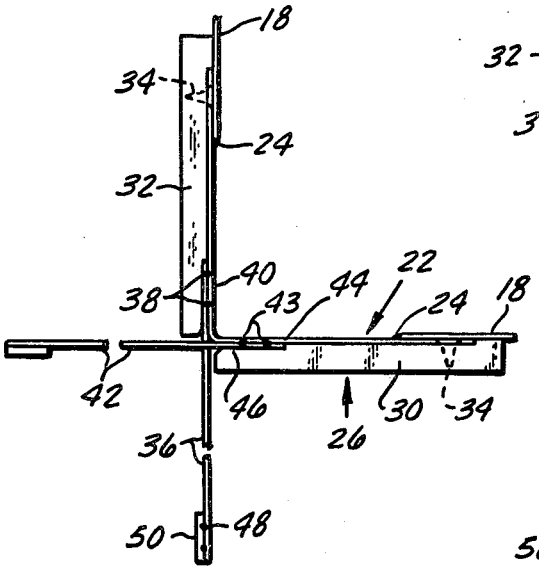
FIG. 3 shows the corner structure of the invention which is employed in the foam insulation system illustrated in FIG. 2.

Referring to FIGS. 1 and 2, a thin primary liner or barrier membrane 18 is positioned in contact with the inner 3D foam insulation layer 16 and can be connected thereto in any suitable manner, such as by the mechanical fastener means shown and described in above applications Ser. Nos. 665,285 and 759,910, comprising tongues 15 (see FIG. 8) which are received and held in position in tongue retainer members in the form of plywood strips 17 which are bonded to the foam insulation layer. The liner 18 is formed of a series of parallel sections or strakes 19, the strakes having upstanding flanges along their longitudinal edges, the flanges of adjacent strakes being connected together. The tongues 15 are positioned between the strake flanges 21 of adjacent strakes 19. Such structure which is described in the above applications forms no part of the present invention. The primary membrane preferably is a low temperature resistant (low thermal expansion) material such as nickel steel, preferably a high nickel steel such as the material marketed as Invar. The membrane 18 is a fluid impermeable material and forms an interior membranous vessel for containment of the cryogenic liquid. A secondary liner 20 is sandwiched between the outer 3D foam insulation layer 14 and the inner 3D foam insulation layer 16. Such liner can be a fiberglass coth liner or a combination of fiber glass cloth with a thin metal, e.g. aluminum, foil, or such secondary liner can be a resin impregnated fiber glass cloth, e.g. impreganated with polyurethane resin, or such resin impregnated fiber glass cloth in combination with a polyvinyl fluoride film marketed as Tedlar. Such secondary liner can be an imperforate liner, which prevents penetration of cryogenic liquid from the inner foam insulation layer 16 to the outer foam insulation layer 14.

Referring to FIGS. 2 to 5 of the drawing, the corner structure of the invention is here illustrated as incorporated at a 90° corner. At such corner there is provided an angle member 22 which, like the primary membrane 18, is comprised of a low temperature resistant material having a low coefficient of thermal expansion, such as nickel steel, preferably a high nickel steel such as Invar, which is attached as by welding at 24, to the primary membrane or liner 18. A support member or back-up 26 for the angle member 22, is incorporated in the inner foam insulation layer 16 adjacent the angle member, the support member being bonded at 28 to the foam. Such support or back-up member 26 is preferably in the form of plywood and is comprised of a pair of support or plywood members 30 and 32 positioned at a 90° angle to each other and in contact with the outer surfaces of each face of the 90° angle member 22. The support or back-up member 26 not only serves as a support for angle member 22, but also serves to stabilize the primary membrane 18 and provide a base for welding. The angle member 22 is attached to the plywood support or back-up member 26 by means of screws 34.

A first series of metal strips 36 are connected at their inner ends as by welding at 38, to one face 40 of angle member 22, and a second series of metal strips 42, similar to strips 36, are similarly connected at their inner ends as by welding at 43 to the other face 44 of angle member 22. The strips or fingers 36 and 42 are comprised of a low thermal conductivity (low coefficient of thermal conductivity) and high strength material, such as stainless steel, for transmission of loads from the primary liner 18 to the ship hull 12. It will be seen in FIG. 3 that the first series of strips 36 and the second series of strips 42 are positioned at a 90° angle to each other, and that the first series of strips 36 are in substantially the same plane as the primary membrane 18 and angle member 22 in one direction thereof at the corner, and the second series of strips 42 are substantially in the same plane as the primary liner 18 and angle member 22 in the other direction thereof at the corner.

Figure 4:
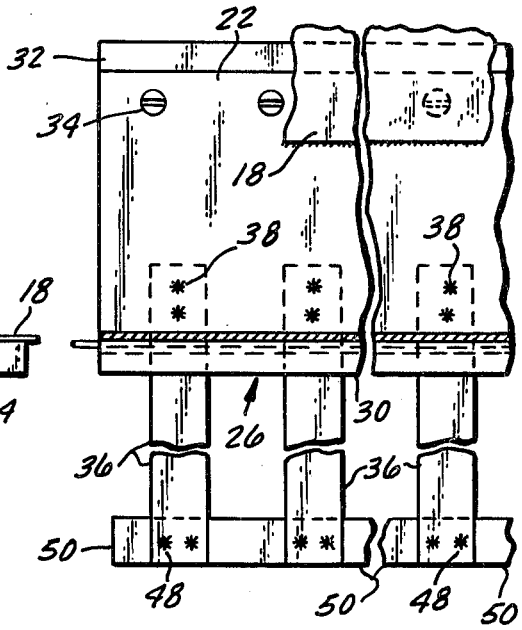
FIG. 4 is a plan view of the corner structure shown in FIG. 3.
Figure 5:
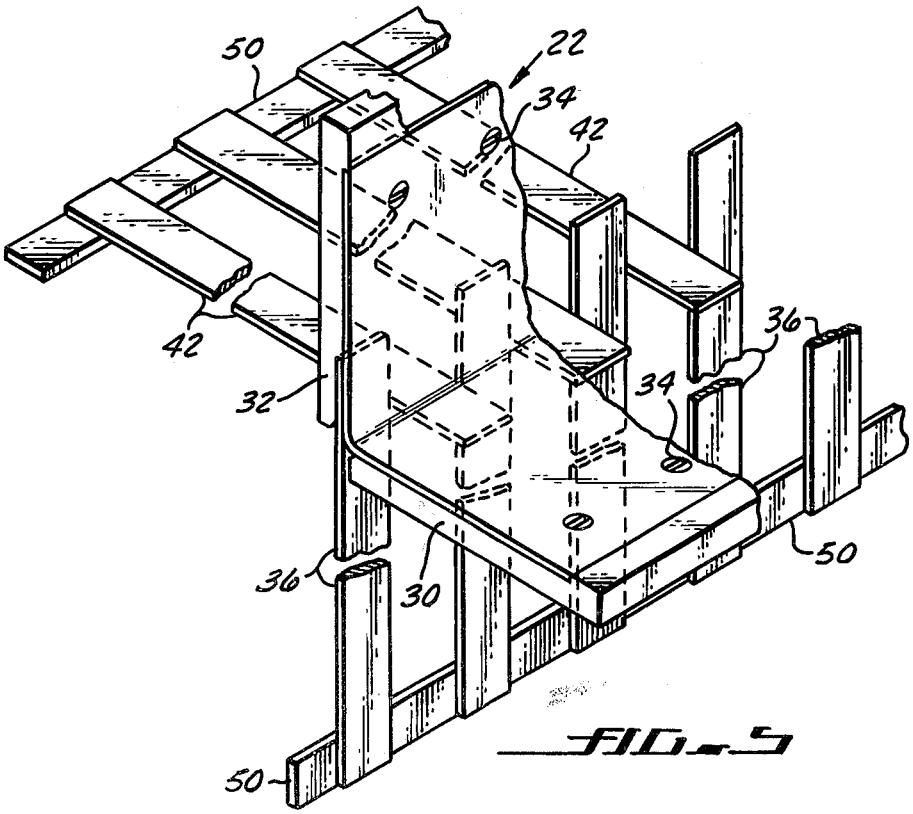
FIG. 5 is an isometric view showing the alternate or staggered relation of one series of strips or fingers, with respect to the other series of strips in the corner structure.

Referring to FIGS. 4 and 5, it will be seen that the first series of strips 36 is comprised of a plurality of spaced parallel strips, and the second series of strips 42 are likewise in the form of a plurality of spaced parallel strips, the second series of strips 42 being staggered or alternated with respect to the first series of strips at the corner. It will be noted that the inner ends of the respective strips 36 and 42 are positoned in grooves 46 formed in the respective portions 30 and 32 of the suppot member 26 and hence as previously noted, the support member 26 functions as a base for the welding of membrane 18 to the angle member 22, as indicated at 38 and 43. The fingers 36 and 42 are proportioned, particularly with respect to the width thereof, to accommodate and match the predetermined load intensities to be transmitted from the primary liner 18 to the ship hull 12.

The other ends of the fingers 36 are attached as by welding at 48 to a metal strip 50 which in turn is supported on a fitting, such as the "T" fitting 52, which in turn is connected to the ship hull 12. Thus, the strip 50 is mounted in vertical position in a groove 54 within the upper portion of the "T" 52, and is held therein by angle 56 which abuts the outer surface of fingers 36 and is connected to the lower portion of the "T" fitting by a nut and bolt fastener 58. The "T" 52 is connected as by welding at 60 and by means of stud 62 to the inner ship hull 12,, a metal shim 64 being interposed between the flat outer surface of the "T" and the adjacent container wall or ship hull 12.

A similar system of components is utilized for attaching the outer ends of the second series of strips 42 to the ship hull 12, including elements 50, 52, and 56 to 64.

A corner support panel 66 is provided and mounted on the two "T" fittings 52 at the corner, by means of the studs 62, for supporting the foam insulation layers 14' and 16' at the corners. It is noted that the corner support panel 66 is preferably formed of a metal such as steel. Longitudinal support panels 68, preferably of plywood, are also provided and connected to the nut and bolt connections 58 of the "T" fittings 52 at opposite corners, for supporting the main body of outer and inner foam insulation layers 14 and 16, along the length and width of the tank, and spaced from the wall of the ship hull 12. The insulation support panels 66 and 68, which maintain the foam insulation system spaced from the inner wall of the container or ship hull, afford a water sump to trap water adjacent the inner ship hull.

There is also provided adjacent the corners, as seen in FIG. 2, a member 70 incorporated in the foam adjacent the ends of the primary liner 18, such fitting 70 containing a plurality of gas purge channels 72 for removal of gases from behind the primary liner 18. Such fitting 70 is supported on a member 74 inserted in a suitably provided groove 76 in the inner foam insulation liner 16, the support member 74 preferably being formed, for example, of plywood, and adhesively bonded to the adjacent foam insulation layer 16.

Viewing particularly FIG. 2, it will be seen that the simple construction of the corner support of the invention, consisting essentially of the two series of strips or fingers 36 and 42, connected to the angle member 22 and to the "T" fittings 52, permit the fitting of the insulation layers 14' and 16' into the corner and around and between the strips or fingers 36 and 42 with a minimum of disruption or discontinuity of the foam insulation and without requiring the fitting of specially shaped and small pieces of foam around the elements, as required in the prior art. Also, it will be seen that the strips or fingers 36 and 42 permit the passage of the secondary, e.g. fiberglass cloth, membrane 20 therebetween, at the corners, thus assuring structural continuity of this membrane.

The corner structure of the invention comprised essentially of the strips 36 and 42 connected at one end to the angle member 22 and at the other end to the "T" fittings 52, is particularly designed to take high corner loads in tension and also to take compression loads, applied by the primary membrane. Such strips or fingers, preferably comprised of a low thermal conductivity and high strength material such as steel, particularly transmit the membrane loads in the various directions and angles to the wall of the tank or ship hull, with minimum disruption or potential damage to the adjacent foam insulation.

It is noted that both the primary membrane or liner 18, and the angle member 22 are formed of a material, preferably high nickel steel such as Invar, having a very low coefficient of thermal expansion. In contrast, the strips or fingers 36 and 42 have a higher coefficient of thermal expansion, but a lower coefficient of thermal conductivity, and are stronger than the material of membrane 18 and angle member 22. This provides the advantages that less heat is transmitted from the outer tank structure to the primary membrane, and there is greater strength in the support structure for withstanding and transmitting loads from the primary membrane to the outer tank wall or hull. Another advantage is that by use of strips or fingers to support the primary membrane at the corners instead of larger single pieces of metal, loads are not developed in a longitudinal direction along the strips, and shrinkage loads at the ends of the strips are thus substantially reduced.

Figure 6:
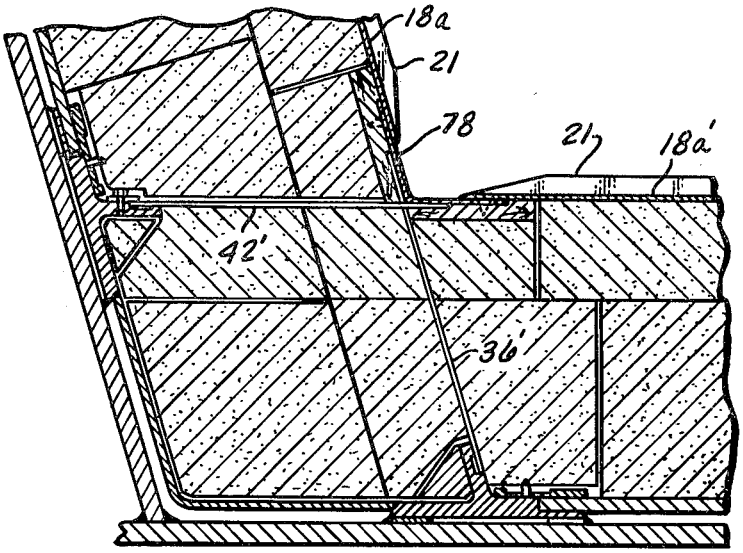
FIG. 6 is a section similar to FIG. 2, showing use of the corner structure of the invention at a corner of a tank forming an obtuse angle.

FIG. 6 illustrates application of the simple yet rugged corner structure of the invention at an obtuse angle of the tank or tanker. Thus, it will be seen that the angle member 78, which is connected to the primary liner 18 in the manner noted above, forms an obtuse angle, and the two series of metal strips 36' and 42' are disposed at a similar obtuse angle with respect to angle member 78, the first series of metal strips 36' being substantially in the same plane as one face 18*a* of the primary membrane at the corner, and the other series of strips 42 being substantially in the same plane as the other face 18*a'* of the primary liner at the corner. The corner structure of the embodiment of FIG. 6 is otherwise the same as the corner structure for the 90° angle shown in FIG. 2.

Figure 7:
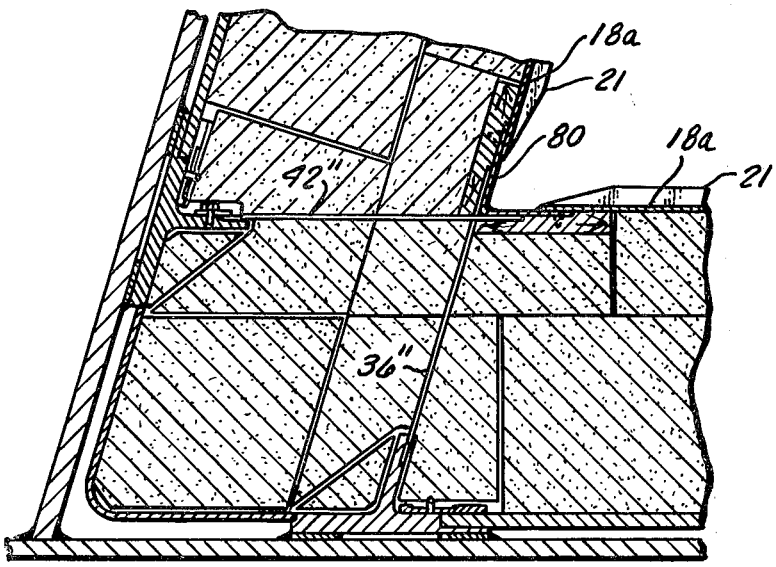
FIG. 7 is a section similar to FIG. 2, showing the use of the corner structure of the invention at a corner of a tank forming an acute angle.

FIG. 7 shows the application of the corner structure of the invention at a corner of a tank or tanker in the form of an acute angle. In this embodiment, angle member 80, similar to angle member 22, forms an acute angle at the corner, and the first series of strips 36" and the second series of strips 42" form a similar angle, with the strips 36" again being substantially in the same plane as one direction or face 18*a* of the primary liner 18, and the other series of strips 42" being substantially in the same plane as the other face or direction 18*a'* of primary liner 18.

It will be noted that in the corner structure of FIGS. 2, 6 and 7, employing two series of strips or fingers, the upstanding parallel strake flanges 21 on the primary liner strakes 19, in both directions of the liner 18 at the corner, are perpendicular to the corner, as also seen in FIG. 1, adjacent the section taken on line 2—2 thereof.

Figure 8:
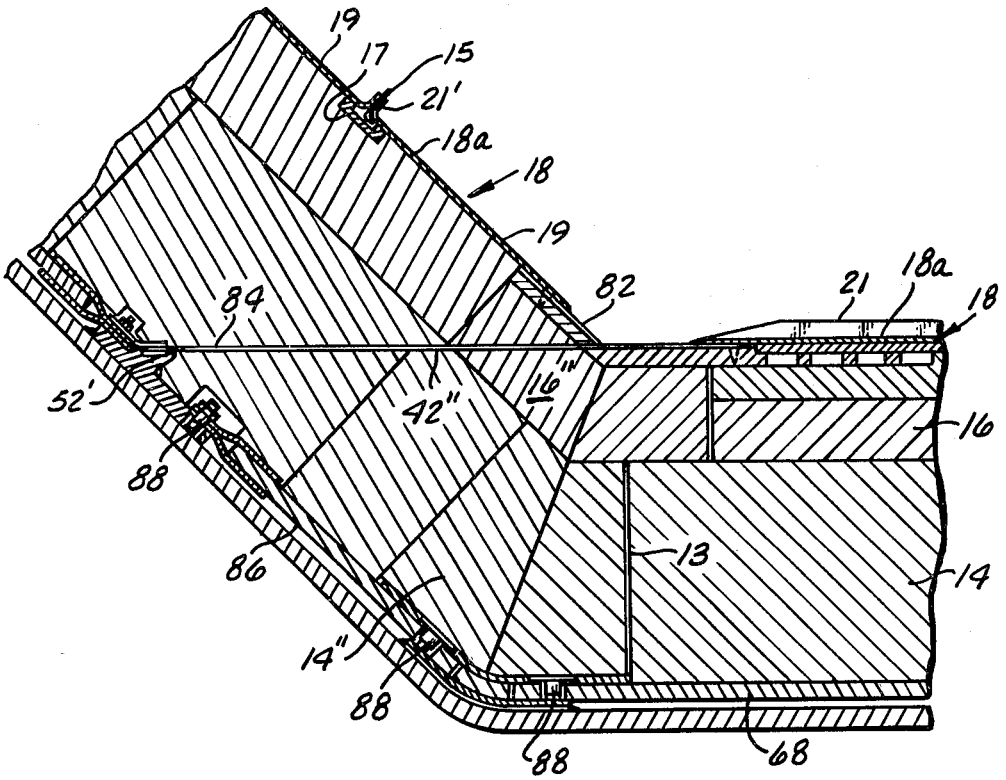
FIG. 8 is a section taken on line 8—8 of FIG. 1, showing a corner according to the invention employing only one series of strips.

However, where the strake flanges in one direction or face of the primary liner at the corner are perpendicular to the corner, and the strake flanges in the other direction or face of the primary liner at the corner are parallel to the corner, then only one series of fingers need be employed, for connecting and supporting that liner portion with the strake flanges perpendicular to the corner, to the container wall or ship hull. This is illustrated in FIG. 8, showing the corner structure at a 135° corner of the tank in FIG. 1. In this modification, it will be seen that the upstanding strake flanges 21 connected to the face 18*a'* of the liner 18 in one direction thereof at the corner, are perpendicular to the corner, whereas the upstanding strake flanges 21' connected to the face 18*a* of the primary liner 18 in the other direction thereof at the corner are disposed parallel to the corner, as seen more clearly in FIG. 1 at the section taken on line 8—8 thereof.

Under the latter conditions, viewing FIG. 8, only one series of metal strips 42", similar to strips 42, are connected to the angle member 82 and to the "T" fitting 52', the series of metal strips 42" in FIG. 8 being substantially in the same plane as the face 18*a'* of the primary membrane containing the strake flanges 21 which are perpendicular to the corner. This corner structure employing the fingers 42" thus supports the primary liner portion 18*a* ', for example, when it is subjected to contraction loads, for example. However the other face or portion 18*a* of the primary liner at the corner, and in which the strake flanges 21' are disposed parallel to the corner, can absorb contraction loads without requiring the support of the metal fingers such as 42" at the corner, and hence no metal fingers are used to connect liner portion 18*a* at the corner to the container wall or ship bull in this modification.

The corner structure of FIG. 8 is otherwise similar to that of FIG. 2 employing substantially the same elements, except that a plywood panel 86 is utilized at the corner for supporting the foam insulation layers 14" and 16" at the corner, instead of the metal support panel 66 in FIG. 2. Such corner support panel 86 is mounted on studs 88 connected to the inner ship hull 12.

From the foregoing, it is seen that the invention provides a novel corner structure for supporting the primary liner of a cryogenic insulation system for tanks and ships, designed especially to transmit loads in various directions from the primary membrane to the inner ship hull, employing a simple structure comprised essentially of a plurality of parallel strips, which substantially reduces the complexity of the foam insulation at the corner structure, and reducing heat leaks to the cold contents of the container.

Although the cryogenic insulation system of the invention is particularly effective for use on ships or tankers, such system can be used on any container for cryogenic liquids, including barges, storage tanks, aircraft or space vehicles. The thickness of the 3D fiber reinforced foam insulation in the system can be varied to limit the boiloff to suit the need of the specific design.

While I have described particular embodiments of my invention for purposes of illustration, it is understood that other modifications and variations will occure to those skilled in the art, and the invention accordingly is not to be taken as limited except by the scope of the appended claims.

What is claimed is:

1. A container for cryogenic liquefied gases which comprises a container wall, at least one fiber reinforced foam insulation layer disposed within said container wall, a low temperature resistant low thermal expansion metal liner in contact with the inner side of said at least one foam insulation layer, said container having corners and including at least one corner structure, said corner structure comprising a corner support, said corner support being disposed in said at least one foam insulation layer adjacent said metal liner at said corner of said container wall, a low temperature resistant low thermal expansion metal angle member, means connecting said metal liner to said angle member, means connecting said angle member to said corner support, a plurality of metal strips, means connecting said metal strips adjacent one end therof to said angle member, and means connecting said metal strips adjacent the other end thereof to the wall of said container, said strips comprised of a metal having low thermal conductivity and high strength, said strips transmitting loads from only one face of said metal liner at said corner to the wall of said container, said plurality of metal strips consisting of spaced substantially parallel strips, all of said strips being substantially in the plane of said one face of said liner in only one direction thereof at said corner, said metal liner comprising a plurality of parallel strakes, said strakes having upstanding flanges along their longitudinal edges, the flanges of adjacent strakes being connected together, the flanges of said metal liner in said one face of said liner in said one direction thereof at said corner being perpendicular to the corner, and the flanges of said metal liner in another face of said liner in another direction thereof at said corner being parallel to said corner.

2. A container as defined in claim 1, said corner forming an obtuse angle, said angle member being an obtuse angle.

3. A ship for transporting cryogenic liquefied gases which comprises a ship hull, a foam insulation system including an inner primary fiber reinforced polyurethane foam insulation layer, and an outer secondary fiber reinforced polyurethane foam insulation layer, said layers being X, Y and Z fibers reinforced polyurethane foam insulation layers, said outer foam insulation layer being positioned adjacent said inner ship hull, a primary low temperature resistant low thermal expansion metal liner disposed adjacent the inner surface of said primary foam insulation layer, a secondary liner on the inner surface of said secondary foam insulation layer and between adjacent surfaces of said primary and secondary foam insulation layers, and said ship having corners and including at least one corner structure, said corner structure comprising a corner support, said corner support being disposed in said inner foam insulation layer adjacent said metal liner at said corner of said ship, a low temperature resistant low thermal expansion metal angle member at said corner, means connecting said metal liner to said angle member, means connecting said angle member to said corner support, a plurality of metal strips, said strips comprised of a metal having low thermal conductivity and high strength, means connecting said metal strips adjacent one end thereof to said angle member, and means connecting said metal strips adjacent to the other end thereof to said ship hull, said strips transmitting loads from only one face of said metal liner at said corner to said ship hull, said plurality of metal strips consisting of spaced substantially parallel strips, all of said strips being substantially in the plane of said one face of said primary liner in only one direction thereof at said corner, said primary metal liner comprising a plurality of parallel strakes, said strakes having upstanding flanges along their longitudinal edges, the flanges of adjacent strakes being connected together, the flanges of said primary metal liner in said one face of said liner in said one direction thereof at said corner being perpendicular to the corner, and the flanges of said primary metal liner in another face of said liner in another direction thereof at said corner being parallel to said corner.

4. A ship for transporting cryogenic liquefied gases as defined in claim 3, said corner forming an obtuse angle, said angle member being an obtuse angle.

* * * * *